US007096705B2

(12) United States Patent
Segal

(10) Patent No.: US 7,096,705 B2
(45) Date of Patent: Aug. 29, 2006

(54) SHEAR-EXTRUSION METHOD

(76) Inventor: Vladimir M. Segal, 2874 Laurel Ridge La., Howell, MI (US) 48843

( * ) Notice: Subject to any disclaimer, the term of this patent is extended or adjusted under 35 U.S.C. 154(b) by 32 days.

(21) Appl. No.: 10/927,608

(22) Filed: Aug. 27, 2004

(65) Prior Publication Data

US 2005/0081594 A1 Apr. 21, 2005

Related U.S. Application Data

(60) Provisional application No. 60/512,260, filed on Oct. 20, 2003.

(51) Int. Cl.
*B21C 23/00* (2006.01)

(52) U.S. Cl. ..... 72/253.1; 72/64; 72/263; 72/272

(58) Field of Classification Search ..... 72/64, 72/65, 253.1, 256, 263, 272, 342.1, 467
See application file for complete search history.

(56) References Cited

U.S. PATENT DOCUMENTS 3,583,204 A * 6/1971 Nilsson ..... 72/467
3,884,062 A * 5/1975 Green ..... 72/60
4,300,378 A * 11/1981 Thiruvarudchelvan ..... 72/253.1
5,327,763 A * 7/1994 Kramer et al. ..... 72/257
5,461,898 A * 10/1995 Lessen ..... 72/256
5,596,895 A * 1/1997 Bredal ..... 72/16.5
5,737,959 A * 4/1998 Korbel et al. ..... 72/362

FOREIGN PATENT DOCUMENTS

SU 1574308 * 2/1987

* cited by examiner

*Primary Examiner*—Ed Tolan
(74) *Attorney, Agent, or Firm*—Wam Hoffmann Miller & LaLone PC

(57) ABSTRACT

A shear-extrusion method of severe plastic deformation for fabrication of metal shapes with ultra-fine structures is described. The improvements of the method include unidirectional shear of any required intensity during one step processing and under high hydrostatic pressures, fabrication of long products with different cross-sections, refinement of low ductile alloys, the increase of productivity and cost reduction. The method can be realized as forward extrusion, backward extrusion, semi continuous extrusion and extrusion of hollow shapes in portal dies with a welding chamber.

21 Claims, 4 Drawing Sheets section A-A section C-C

SHEAR-EXTRUSION METHOD

CROSS REFERENCE TO RELATED APPLICATIONS

This application claims the benefit of U.S. Provisional Application No. 60/512,260 filed Oct. 20, 2003, the entire specifiсation of which is expressly incorporated herein by reference.

BACKGROUND OF THE INVENTION

1. Field of the Invention

The present invention relates to severe plastic deformation of metals and alloys to control their structure and properties.

2. Description of the Prior Art

It is known in the art that severe plastic deformation performed by simple shear results in refinement of grain structures to the sub-micron, sometimes to nano scale. That leads to significant improvements in many physical and mechanical properties such as strength, ductility, fatigue, corrosion resistance, super plasticity, etc. Different processing methods were developed for intensive plastic deformation. Most of them are restricted by small sample sizes or soft materials and are used as a laboratory tool: high pressure torsion (P. W. Bridgeman, Studies in Large Plastic Flow and Fracture, McGrill, New York, 1952), cyclic extrusion-compression (A. Korbel, M. Richert, J. Richert, in: Second RISO International Symposium on Metallurgical Science, 1981, p. 485), repetitive corrugation and straightening (U.S. Pat. No. 6,197,129). Some techniques allow processing of sufficiently large billets and have potentials for industrial applications: equal channel angular extrusion (ECAE) (Invention Certificate of the USSR No 575892, 1974), accumulative roll-bonding (Y. Saito, N. Tsuji, H. Utsonomiya, T. Sakai and R. G. Hong, "Scripta Materialia", 39, 1998, p. 1221), twist-extrusion (J. Beigelzimer, D. Orlov and V. Varyhin, in: "Ultrafine Grained Materials-II", 2002, p. 297) and multi-directional forging (U.S. Pat. No. 6,422,090). Equal channel angular extrusion is considered the most promising candidate for practical applications and was used in many patents (see U.S. Pat. Nos. 5,400,633; 5,513,512; 5,600,989; 5,826,456; 5,850,755; 5,904,062). However, all these techniques are characterized by a few important disadvantages. As effective strains per pass are usually less than $\epsilon \leqq 1$ whereas accumulated strains for structure refinement ranges from $\epsilon=6$ to $\epsilon=12$, a large number of processing steps or passes should be used. Each pass requires billet preparation, preheating and lubrication. In result, such processing is time and labor consuming with a high product cost. Also, only simple billet shapes like short bars, rods or plates can be fabricated. In most cases, their conversion to final products presents additional problems with the increase in the cost. Therefore, these techniques are effective only for special applications. For example, the only reported commercialization of equal channel angular extrusion relates to sputtering targets in electronic and semiconductor industries (U.S. Pat. Nos. 5,590,389; 6,569,270).

It is very desirable to develop a cost effective industrial method for fabrication of complicated shapes like long extrusions with ultra-fine grained structures. These products may have numerous applications as structural materials in automotive, transportation, aero-space and other industries. However, the only known method in the art for such products is superplastic extrusion (see U.S. Pat. No. 5,620,537). This method comprises two step processing: (i) equal channel angular extrusion to prepare ultra-fine structures and (ii) superplastic extrusion. The first step conserves the above mentioned disadvantages of multi-pass ECAE. The second step should be realized with very low strain rates or high temperatures that leads to low productivity and degradation of the material structure and properties. Therefore, the known method does not provide evident technical benefits and did not find practical applications. The present invention is intended to resolve all these and other problems.

SUMMARY OF THE INVENTION

An object of the invention is a method of severe plastic deformation to attain high strains during one step processing necessary for structure refinement and to form simultaneously long products of different shapes. In accordance with the invention, the shear-extrusion method comprises the steps of providing cylindrical billets of materials, billet preheating, placing the billet into a container of the extrusion tool, forcing the billet for extruding through an extrusion die and for shearing of billet parts located inside the container and inside the die by their relative motion along and rotation about a billet axis, controlling the extrusion and angular speeds, continuing the step of forcing to pre-established length of a billet remainder into the container, and repeating the steps of providing, preheating, placing, forcing, controlling and continuing for successive billets.

The method also includes the material selection from the group of aluminum alloys; high silicon aluminum alloys; magnesium alloys; titanium alloys; powders, machine swart and composites.

During shear-extrusion of successive billets, they may be friction welded for fabrication of continuous extrusions by rotation under controllable pressure. To facilitate welding, billets are provided with conical ends and shallow grooves along a cylindrical billet surface.

The required shear strain intensity [γ] inside a billet volume confined between outside radius R and inside radius r is selected in accordance with the formula $$\omega/V=[\gamma]R/r,$$

where ω is the angular speed of rotation, V is the extrusion speed.

The method further includes a control of the billet preheating temperature and the extrusion speed. In one case, the preheating temperature and the extrusion speed are controlled in such manner that the maximum temperature inside the extrusion die remains below the temperature of dynamic stability of the refined structure during the extrusion time. Additionally, the extruded shapes may be cooled down directly after leaving the outlet orifice. In another case, the billet preheating temperature and the extrusion speed are controlled in such manner that the maximum temperature and strain rate inside the extrusion die are within the dynamic superplastic window for the refined material structure during the extrusion time.

One embodiment of the method is the selection of the extrusion reduction in such manner that provides the necessary hydrostatic pressure for structure refinement during severe shearing.

The invention also includes a tool for forward shear-extrusion, a tool for backward shear-extrusion, a die for shear-extrusion and a portal die for shear-extrusion of hollow shapes.

DETAILED DESCRIPTION OF THE INVENTION

Figure 1:
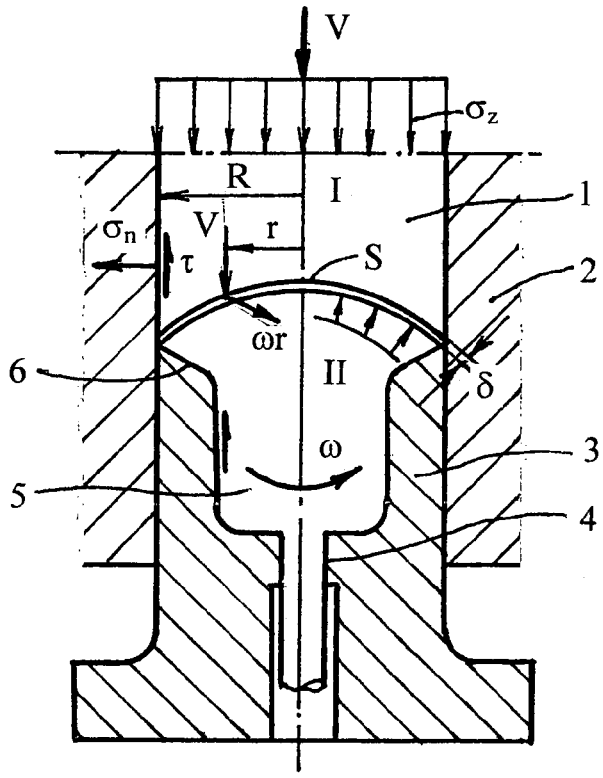
FIG. 1 is a view showing the principle of the shear-extrusion method.
Figure 2:
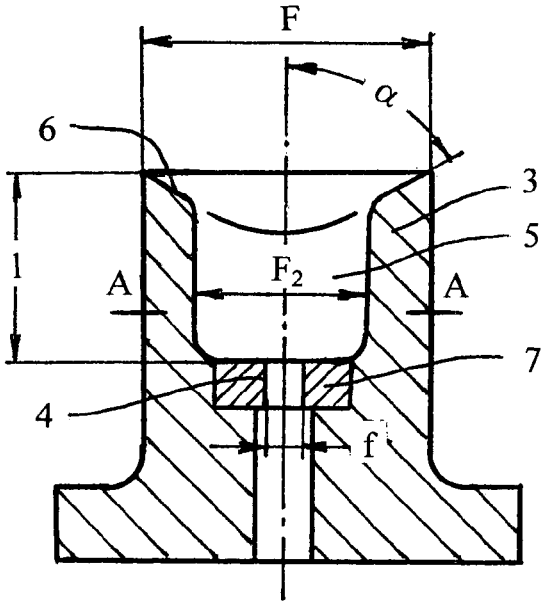
FIG. 2 shows an extrusion die for the shear-extrusion method.
Figure 3:
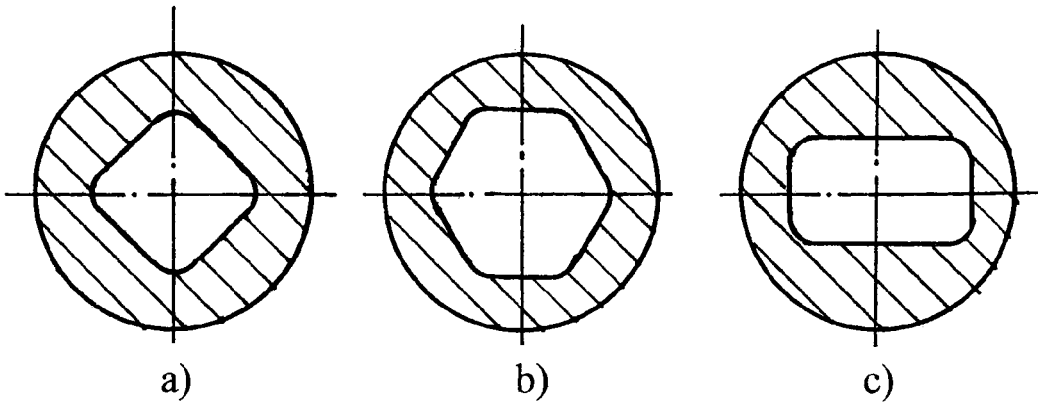
FIG. 3 shows possible cross-sections of an intermediate chamber of the extrusion die.

Now, the invention will be described in details with reference to accompanying figures. FIG. 1 shows the principle of the shear-extrusion process. Similarly to ordinary extrusion, a cylindrical billet 1 is placed into a container 2 of the extrusion tool. The billet 1 is forced for extruding from the container 2 through a die 3 under action of stresses $\sigma_z$ applied by a press (does not shown) moving with an extrusion speed V. The extrusion die 3 is provided with an outlet orifice 4 which defines the extruded product. In contrast to known methods, the die 3 comprises an intermediate extrusion chamber 5 with a cone 6 and is rotated with an angular speed ω relative to the container 2 by an additional mechanism (does not shown). The chamber 5 has non-circular cross-sections of the sufficient length l. The transition cone 6 prevents the penetration of oxides, lubricants and other surface contaminations inside the extruded product. Details of the extrusion die are shown in FIG. 2. The outlet orifice 4 may be performed into an insert 7. FIG. 3 presents possible cross-sections of the chamber 5: (a) square cross-section; (b) hexagonal cross-section; (c) rectangular cross-section.

During extruding, stresses $\sigma_z$ are usually much higher than the material flow stress. Therefore, the billet 1 is in the plastic state which is balanced by normal stresses $\sigma_n$ at container walls. That develops large contact friction τ along the container 2 which prevents the rotation of the billet part I located inside the container. Similar stresses along boundaries of the chamber 5 together with its non-circular cross-section force the material volume II inside the chamber 5 to rotate together with the chamber. In result, intensive shear arises inside a narrow layer S between the volumes I and II (FIG. 1). Because of this rotation, a discontinuity of the tangential velocity component at any point r along the layer S is $$[v]=\omega r$$

whereas the normal velocity component at S is $$v_n=V$$

Therefore, during crossing S, the material particles acquire simple shear $$\gamma=[v]/v_n=r\omega/V \quad (1)$$

This shear reduces in linear proportion with r and γ=0 when r=0. However, because ω is an independent processing parameter, it may be selected sufficiently large to attain the required shear γ at any point r>0. That way very large strains can be induced in the material during one step processing. Depending on processing conditions, there is some critical amount [γ] that results in required structural effects. According with the formula (1), the angular speed $$\omega=[\gamma]V/r \quad (2)$$

will provide such changes inside the material volume confined between radii R and r. That corresponds to the relative material volume $$\eta=[1-(r/R)^2]100\%$$

Calculations show that for (r/R)=0.25, about 93% of the material volume will receive necessary structure evolution. This modified material enters the chamber 5 and extrudes through the orifice 4 producing new technical possibilities that will be considered later.

Figure 4:
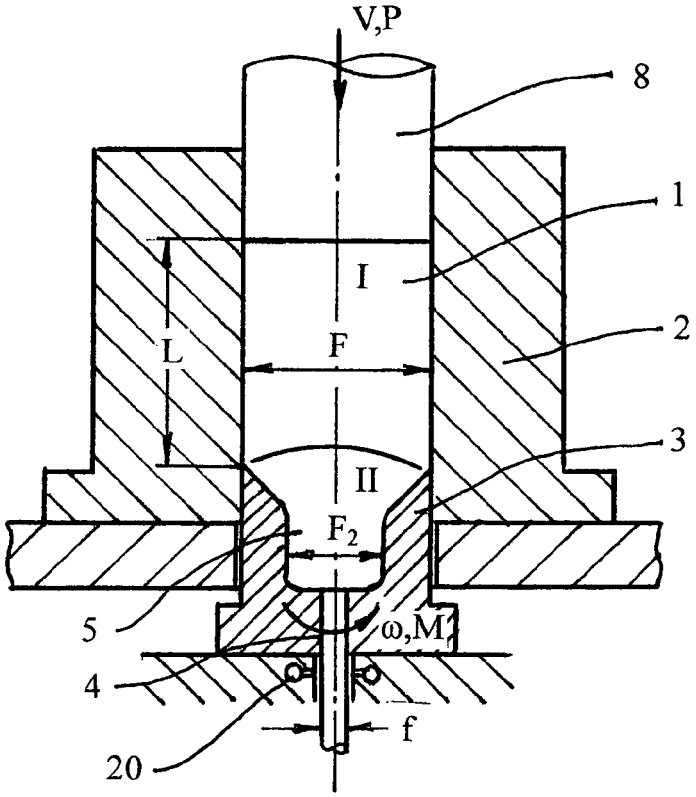
FIG. 4 shows a forward shear-extrusion process.
Figure 5:
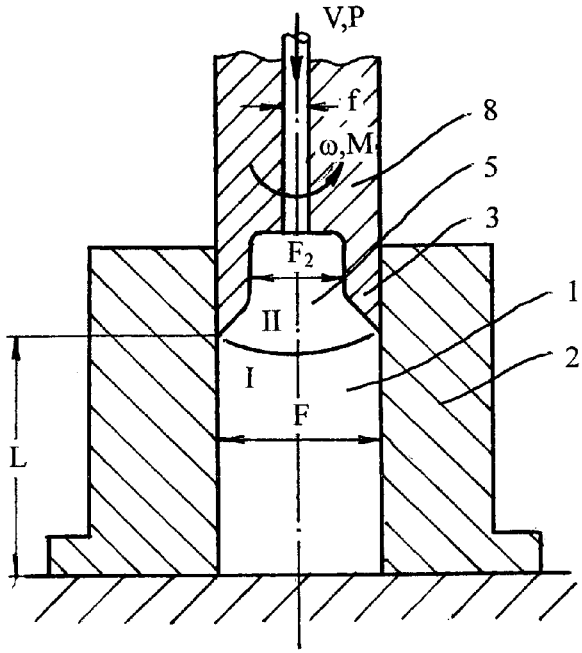
FIG. 5 shows a backward shear-extrusion process.

There are several ways for realization of the shear-extrusion method. FIG. 4 shows a forward shear-extrusion process. In this case, the forcing load P with speed V is applied by a press to a punch 8 that acts on the opposite billet ends to the rotated extrusion die. For a backward shear-extrusion process (FIG. 5), the extrusion load P with speed V is applied directly to the extrusion die 3 performed in the punch 8 whereas the billet 1 is fixed inside the container 2. The rotation may be performed for the punch 8 or for the container 2. In both cases of forward and backward extrusion, the total area reduction λ of the original billet cross-section area F is composed by the partial reduction $\lambda_1$ from the container to the chamber 3 of cross-section $F_2$, and the partial reduction $\lambda_2$ from the chamber 3 to the final cross-section f:

$$\lambda=F/f=\lambda_1\lambda_2,\ \lambda_1=F/F_2,\ \lambda_2=F_2/f$$

The selection of partial reductions $\lambda_1$ and $\lambda_2$ should provide the optimal processing characteristics. For forward shear-extrusion (FIG. 4), the maximum billet length L may be restricted by large friction forces inside the container 2. Backward shear-extrusion (FIG. 5) is especially beneficial as the billet length L does not effect friction forces and the rotation reduces extrusion load from 2 to 3 times. That compensates significant material hardening resulted from intensive straining at low temperatures.

To reduce material waste, the shear-extrusion process is performed for a number of billets in a succession "billet-by-billet". When the previous billet is extruded to an established length of a billet remainder into the container, the die rotation is stopped, the punch is retreated from the container and the following billet is placed into the container. Then, the punch moves into the container, applies the required load P to the billets, the rotation is started, and the previous billet is fully extruded from the die.

As the cone 6 of the extrusion die 3 (FIG. 2) prevents penetration of oxides and other surface contaminations inside the material, the shear-extrusion process may be performed with lubricants to provide controllable contact friction τ and to eliminate material sticking to the tool. However, in accordance with industrial experience, dry friction conditions are the most preferable for light alloys. This material group includes aluminum alloys, magnesium alloys, high silicon aluminum alloys, titanium alloys, powders, machine swart and composites.

Figure 6:
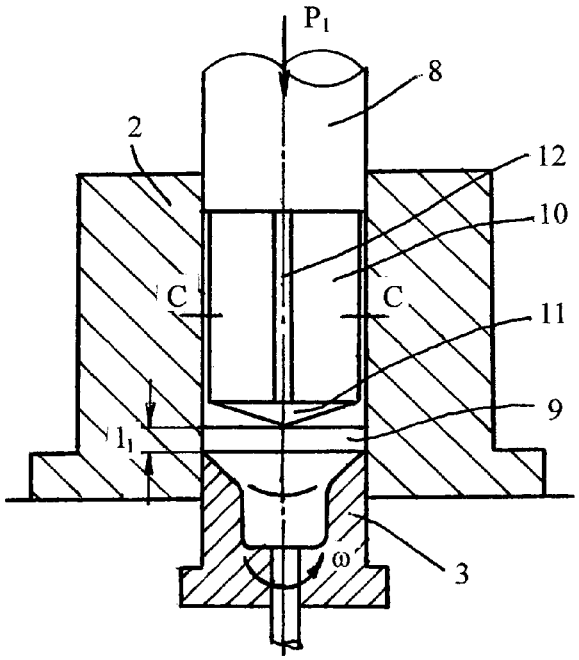
FIG. 6 shows a semi continuous shear-extrusion process.
Figure 7:
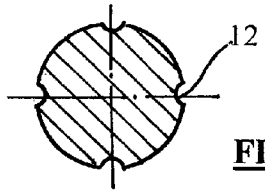
FIG. 7 is a billet cross-section for semi continuous shear-extrusion.
Figure 8:
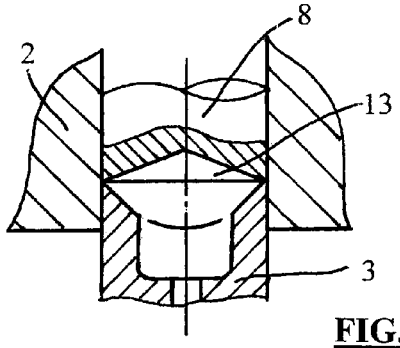
FIG. 8 shows forming of a conical billet end during semi continuous shear-extrusion.

One embodiment of the invention for dry friction conditions is semi-continuous shear-extrusion with friction welding of successive billets (FIG. 6). The previous billet 9 is extruded to an established length $l_1$ that prevents the rotation of the billet part located inside the container 2 when the billet has a full contact with the punch 8 but allows such rotation when the billet has a partial contact with the punch. After inserting the following billet 10 into the container 2, the punch 8 applies the pressure $P_1<P$ which upsets the billet 10 but is not sufficient for shear-extrusion. When the die 4 stars to rotate, intensive sliding under pressure $P_1$ welds the billets. Then, the punch pressure increases to the normal level P necessary for shear-extrusion. To facilitate welding and to remove the air from the container, the billets are provided with conical ends 11 and shallow slots 12 along the cylindrical billet surface (FIG. 7). For backward shear-extrusion (FIG. 5), the conical billet end should be machined. For forward shear-extrusion (FIG. 4), it can be formed by using the punch 8 with corresponding cavity 13 (FIG. 8).

Figure 9:
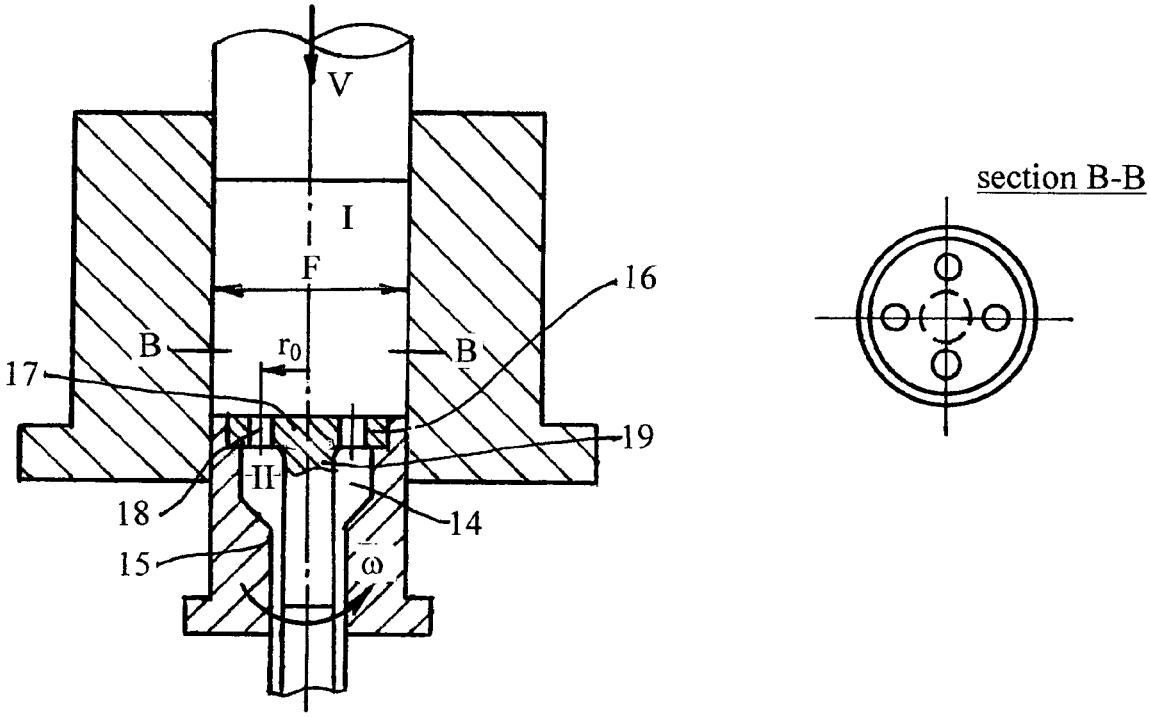
FIG. 9 shows the shear-extrusion method for hollow shapes.

One embodiment of the invention is shear-extrusion of pipes and hollow shapes (FIG. 9). Similarly to known portal dies for extruding hollow cross-sections, a portal die for shear-extrusion comprises a welding chamber 14, an outlet orifice 15, a portal part 16 with bridges 17, feeding windows 18 and a mandrel 19. A gap between the outlet orifice 15 and the mandrel 19 corresponds to the cross-section of the hollow extrusions. During extruding with speed V, the die is rotated with angular speed ω. When the material flows through windows, it acquires simple shear $$\gamma=\omega r_0 f_0/VF$$

where $r_0$ is an average distance of windows from the rotation axis and $f_0$ is a cross-section area of the windows. By selecting a sufficiently high angular speed ω, intensive shear γ results in structure refinement and enhanced diffusion bonding of metal streams inside the welding chamber 14.

Another embodiment of the invention is the control of the hydrostatic pressure during simple shear. This characteristic is very important for structure refinement of many materials which can not be subjected to intensive deformation at low temperatures without fracture. For known methods of severe plastic deformation, the hydrostatic pressure is less than the material flow stress whereas the application of an additional back pressure leads to complex technical problems. However, for shear-extrusion, high hydrostatic pressures along the shear zone S (FIG. 1) are intrinsically developed by two factors: (i) extruding the material from the container through the outlet orifice and (ii) strong material hardening after crossing the shear zone S. This pressure is easy to control by selecting the total extrusion reduction λ=F/f and the chamber length l (FIG. 2). Typically, the hydrostatic pressure p along S is from 4 to 8 times larger than the flow stress of the original billet even for low extrusion reductions λ=2–4. Therefore, the metals with a low ductility such as magnesium alloys and high silicon aluminum alloys may be successfully processed by shear-extrusion to attain ultra fine grained structures with high strength and sufficient ductility, and to form complicated shapes.

Additional embodiment of the invention is the control of extrusion speed and the billet preheating temperature. To provide high productivity and low extrusion pressures, these characteristics should be sufficiently high. However, the refined structures and other attained effects are not stable. For each material, there is the specific temperature-time window of the structural stability. Material heating during crossing of the shear zone S may significantly increase the temperature inside the extrusion die. The intensive simple shear for structure refinement is usually from [γ]=8 to [γ]=16. For aluminum and magnesium alloys, that results in adiabatic heating from 200C. to 300C. A real effect depends on extrusion speed V. For low speeds V<1 mm/sec, adiabatic heating dissipates into the tool and, practically, does not effect the preheating temperature. In this limit case, the structural stability is provided, if the preheating temperature is below the temperature of static recrystallization of the refined structure. In another limit case of high extruding speed V>100 mm/sec with the maximum heating effect, the stability condition is defined by the sum of the preheating temperature and the temperature of adiabatic heating during the time that is necessary for material particles to pass through the extrusion die. As this time typically is less than 1 sec, the maximum temperature may significantly exceeds the temperature of static recrystallization without any degradation of ultra-fine structures. In most practical cases, there are intermediate situations between these limit cases because both adiabatic heating and the time inside the die depends on the extrusion speed V which, ultimately, defines the dynamic conditions of structure stability. Therefore, the billet preheating temperature and the extruding speed should be controlled in such manner that the maximum temperature inside the extruding die remains below the temperature of dynamic stability of the refined structure during the extrusion time.

For structure stabilization, the extruded product may be cooled down directly after leaving the outlet orifice by using a water spray 20 shown schematically in FIG. 4.

In some cases, billet preheating temperature and the extrusion speed may be controlled in such manner that provides conditions of superplastic flow inside the extrusion die. Because the material is exposed to increased temperature during the short time, these characteristics are much broader than that described in U.S. Pat. No. 5,620,537 and correspond to the dynamic temperature-strain rate window of superplasticity for the refined material structure during the extrusion time.

The shear-extrusion method provides a few important advantages. First, this is an one step technique of severe plastic deformation that does not require strain accumulation during multi-pass processing. Second, long complicated shapes including hollow ones can be formed simultaneously with the structure refinement to the sub-micron scale. Third, severe deformation is performed under high and controllable hydrostatic pressures. Therefore, the structure refinement of usually brittle alloys is possible with significant improvement in their strength and toughness. Fourth, processing characteristics of the shear-extrusion method provide high productivity and low product cost which are comparative to the ordinary extrusion methods.

I claim:

1. A method of shear-extrusion of metal shapes with ultra-fine structures, comprising the steps of:

providing a billet of material;

preheating the billet to a predetermined temperature;

placing the billet into an extrusion tool comprising a container, a punch and an extrusion die having an intermediate extrusion chamber and an outlet orifice;

forcing the billet for extruding from the container through the extrusion die at an extrusion speed such that a portion of the billet is in the container and a portion of the billet is in the extrusion die, and shearing the billet portions by providing relative rotation about a billet axis at an angular speed between the billet part in the container and the billet part in the extrusion die.

2. The method of claim 1, wherein the step of providing the billets includes the step of selecting the material from the group consisting of aluminum alloys; high silicon aluminum alloys; magnesium alloys; titanium alleys; powders, machine swart and composites.

3. The method of claim 1, further comprising providing a second billet and friction welding of the second billet with the billet by applying a controllable rotation under an axial force which is less than the extruding force.

4. The method of claim 3, further comprising preparing a conical end on one of the billet or second billet.

5. The method of claim 1, further comprising controlling the angular speed ω of relative rotation and the extrusion speed V of relative motion in such manner that their ratio is sufficiently large to provide structure refinement inside a selected billet area confined between an outside radius R and an inside radius r in accordance with the formula $$\omega/V \geqq [\gamma]R/r,$$

where [y] is the shear strain necessary for the structure refinement.

6. The method of claim 1, wherein the billet preheating temperature and the extrusion speed are further controlled in such manner that the maximum temperature inside the extrusion die remains below the temperature of dynamic stability of the refined structure during the extrusion time.

7. The method of claim 1, wherein the extruded shapes are cooled directly after leaving the outlet orifice.

8. The method of claim 1, wherein the billet preheating temperature and the extrusion speed are controlled in such manner that the maximum temperature and strain rate inside the extrusion die are within a dynamic temperature-strain rate window of superplasticity for the refined material structure during the extrusion time.

9. The method of claim 1, wherein the extrusion die has an area reduction from a container cross-section to an outlet orifice cross section, the area reduction being selected in such manner that provides sufficient hydrostatic pressure to provide structure refinement during shearing.

10. The method of claim 1 further comprising providing an extrusion tool having a container with opposing ends, the extrusion die disposed on one end of the container and the punch at the other end and wherein the extrusion die rotates relative to the one end of the container as the punch is moves against the billet at the other end of the container to thereby impart the relative rotation between the billet part in the container and the billet part in the extrusion die.

11. The method of claim 1 further comprising providing an extrusion tool having a container with opposing ends, the extrusion die disposed in the punch at one end and wherein the container rotates relative to the punch as the punch moves against the billet to thereby impart the relative rotation between the billet part in the container and the billet part in the extrusion die.

12. The method of claim 1 wherein the intermediate extrusion chamber of the extrusion die has a non-circular cross-section.

13. The method of claim 12 wherein the intermediate extrusion chamber of the extrusion die has a transition cone adjacent the container.

14. The method of claim 12, wherein the intermediate extrusion chamber of the extrusion die has a square cross-section area.

15. The method of claim 12, wherein the intermediate extrusion chamber of the extrusion die has a rectangular cross-section area.

16. The method of claim 12, wherein the intermediate extrusion chamber of the extrusion die has a hexagonal cross-section area.

17. The method of claim 1 wherein the die comprises a portal die for making hollow parts.

18. The method of claim 17 wherein the portal die includes a welding chamber.

19. The method of claim 1 wherein the billet is forced from the container through the extrusion die at dry friction conditions without lubricating the billet or tool.

20. The method of claim 4, further comprising providing at least one groove along a cylindrical billet surface on one of the billet or second billet.

21. The method of claim 1 further comprising adding at least one additional preheated billet to the container and repeating the forcing and shearing steps with the at least one additional preheated billet.

* * * * *